US006218062B1

(12) United States Patent
Yuh et al.

(10) Patent No.: US 6,218,062 B1
(45) Date of Patent: Apr. 17, 2001

(54) CHARGE GENERATING LAYER WITH NEEDLE SHAPED PARTICLES

(75) Inventors: Huoy-Jen Yuh, Pittsford; John S. Chambers, Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/416,824

(22) Filed: Oct. 12, 1999

(51) Int. Cl.[7] ..... G03G 5/04
(52) U.S. Cl. ..... 430/59.1
(58) Field of Search ..... 430/59.1, 57.3, 430/57.2

(56) References Cited

U.S. PATENT DOCUMENTS

| | | | |
|---|---|---|---|
| 4,464,450 | 8/1984 | Teuscher | 430/59 |
| 4,518,669 | 5/1985 | Yashiki | 430/57 |
| 4,579,801 | 4/1986 | Yashiki | 430/60 |
| 4,775,605 | 10/1988 | Seki et al. | 430/63 |
| 5,017,449 | 5/1991 | Yoshihara | 430/59 |
| 5,344,734 | 9/1994 | Monbaliu et al. | 430/59 |
| 5,385,796 | 1/1995 | Spiewak et al. | 430/64 |
| 5,449,573 | 9/1995 | Aoki et al. | 430/131 |
| 5,489,496 | 2/1996 | Katayama et al. | 430/62 |
| 5,641,599 | 6/1997 | Markovics et al. | 430/59 |
| 5,656,407 | 8/1997 | Kawahara | 430/78 |
| 5,721,080 | 2/1998 | Terrell et al. | 430/58 |
| 5,928,824 | 7/1999 | Obinata et al. | 430/62 |

FOREIGN PATENT DOCUMENTS

| | | | |
|---|---|---|---|
| 536692 | * | 4/1993 | (EP) . |
| 60-103353 | * | 6/1985 | (JP) . |

OTHER PUBLICATIONS

Chemical Abstracts 103:169852, 2000.*

Borsenberger, Paul M. et al. Organic Photoreceptors for Imaging Systems. New York: Marcel–Dekker, Inc. pp. 330–338, 1993.*

Huoy–Jen Yuh and Zhilei Wang, "Blocking Layer with Needle Shaped Particles", Serial No. 09/416840 (D/97389Q).

* cited by examiner

*Primary Examiner*—Christopher Rodee
(74) *Attorney, Agent, or Firm*—Zosan S. Soong

(57) ABSTRACT

A photoreceptor including: (a) a substrate; (b) a charge generating layer including a binder, a n-type charge generating material, and a plurality of needle shaped n-type particles; and (c) a charge transport layer, wherein the charge generating layer and the charge transport layer are in any sequence over the substrate.

11 Claims, 3 Drawing Sheets

CHARGE GENERATING LAYER WITH NEEDLE SHAPED PARTICLES

FIELD OF THE INVENTION

This invention relates to a photoreceptor useful for an electrostatographic printing machine.

BACKGROUND OF THE INVENTION

Benzimidazole perylene particles are a known extrinsic charge generating material that can be employed in a charge generating layer of a photoreceptor. Photogenerated charge carriers need to be brought out of the surface of the benzimidazole perylene particles before the charge carriers recombine and move into the charge transport layer under the applied electric field. The process is slowed down in certain types of binder resin employed in the charge generating layer, especially at low electric field. Therefore, the photoinduced discharge curve ("PIDC") gets softer at low electric field. Soft PIDC means that as the exposure light energy is increased, the amount of surface voltage change due to the exposure of the photoreceptor to light is proportionally less. Such a soft PIDC will require a more powerful light source for imaging. Thus, there is a need, which the present invention addresses, for a more sensitive photoreceptor. A photoreceptor with enhanced sensitivity will reduce the need to employ a more powerful light source, thereby reducing cost.

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449.

Conventional charge blocking layers are also disclosed in U.S. Pat. No. 4,464,450; U.S. Pat. No. 5,449,573; U.S. Pat. No. 5,385,796; and Obinata et al, U.S. Pat. No. 5,928,824.

SUMMARY OF THE INVENTION

The present invention is accomplished in embodiments by providing a photoreceptor comprising:

(a) a substrate;

(b) a charge generating layer including a binder, a n-type charge generating material, and a plurality of needle shaped n-type particles; and (c) a charge transport layer, wherein the charge generating layer and the charge transport layer are in any sequence over the substrate.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in different Figures refers to the same or similar feature.

DETAILED DESCRIPTION

Figure 1:
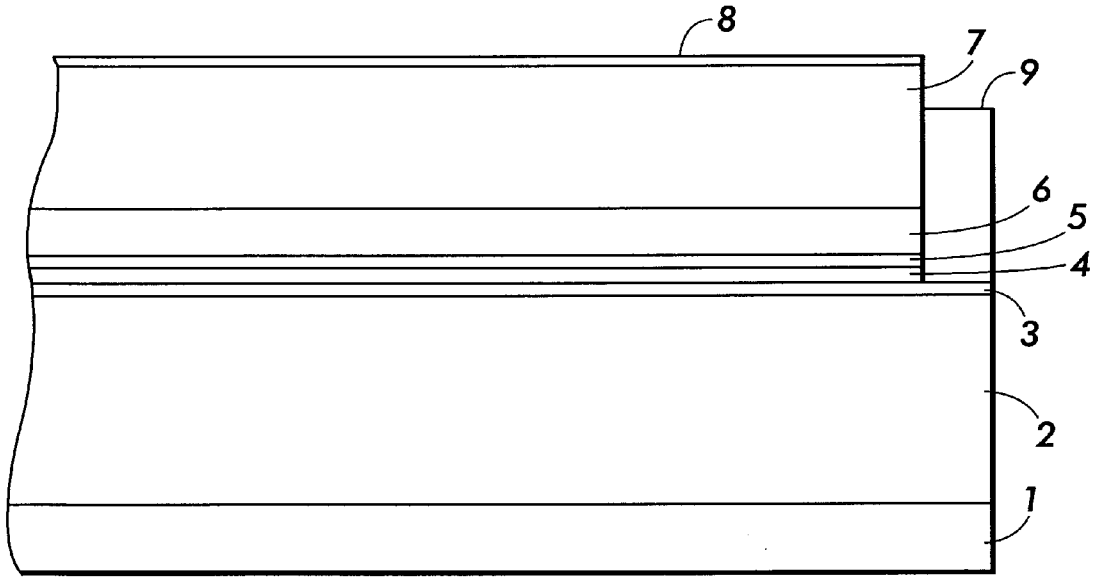
FIG. 1 represents a simplified side view of a first embodiment of the inventive photoreceptor.
Figure 2:
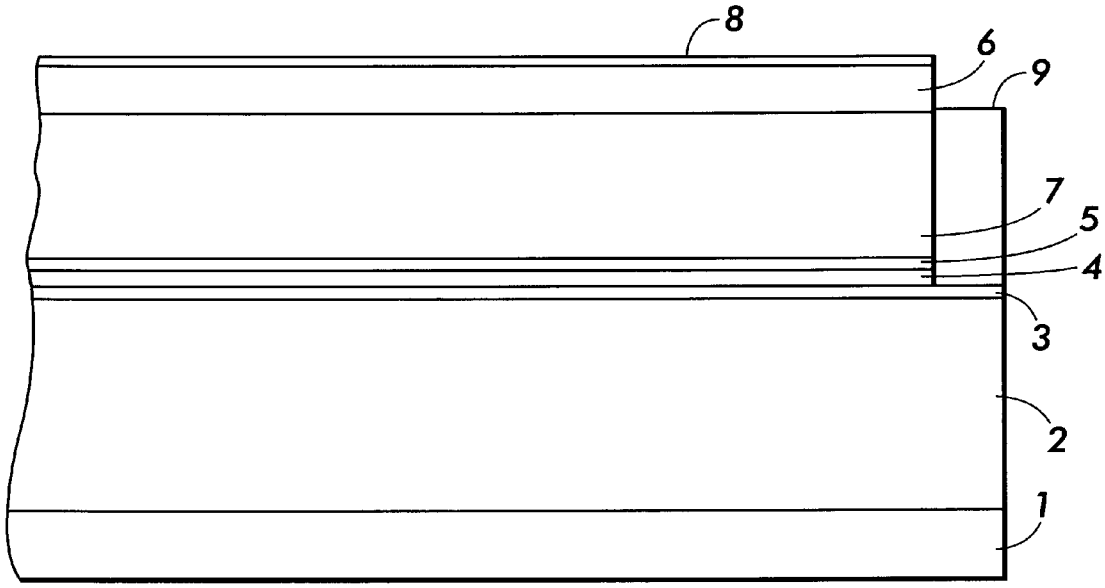
FIG. 2 represents a simplified side view of a second embodiment of the inventive photoreceptor.
Figure 3:
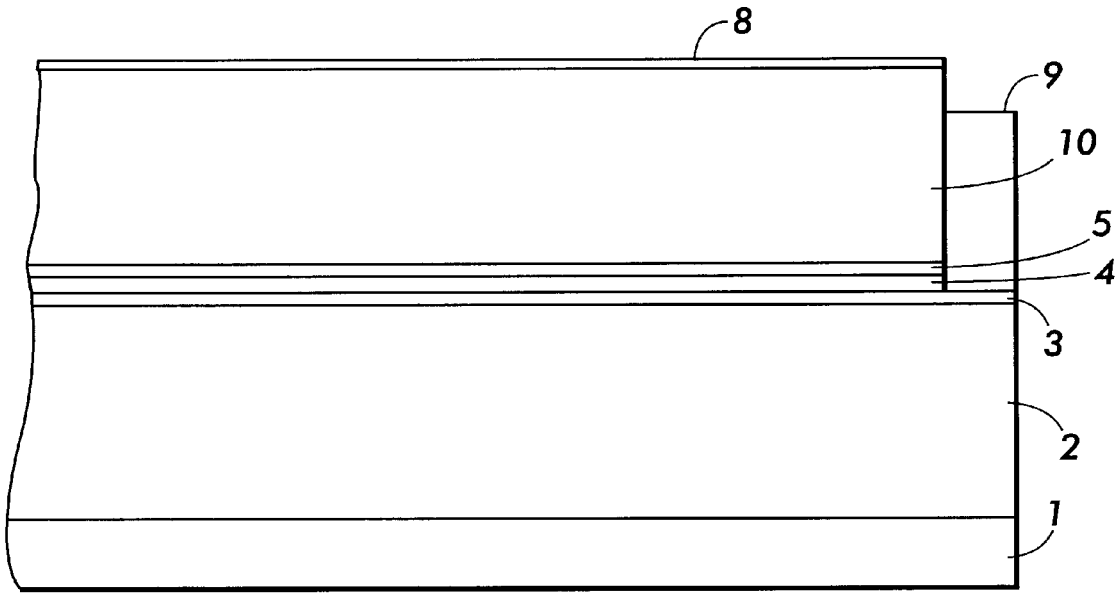
FIG. 3 represents a simplified side view of a third embodiment of the inventive photoreceptor.

Representative structures of an electrophotographic imaging member (e.g., a photoreceptor) are shown in FIGS. 1–3.

These imaging members are provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9. In FIG. 3, imaging layer 10 (containing both charge generating material and charge transport material) takes the place of separate charge generating layer 6 and charge transport layer 7.

As seen in the figures, in fabricating a photoreceptor, a charge generating material (CGM) and a charge transport material (CTM) may be deposited onto the substrate surface either in a laminate type configuration where the CGM and CTM are in different layers (e. g. , FIGS. 1 and 2) or in a single layer configuration where the CGM and CTM are in the same layer (e. g. , FIG. 3) along with a binder resin. The photoreceptors embodying the present invention can be prepared by applying over the electrically conductive layer the charge generation layer 6 and, optionally, a charge transport layer 7. In embodiments, the charge generation layer and, when present, the charge transport layer , may be applied in either order.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4,4'-isopropylidene diphenylcarbonate), poly(4,4'-cyclohexylidene diphenylcarbonate), mixtures thereof and the like.

Additives may be present in the anti-curl layer in the range of about 0.5 to about 40 weight percent of the anti-curl layer . Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U. S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a mulilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a scroll, an endless flexible belt, a web, a cylinder, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, suicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where a drum is used, the thickness should be sufficient to provide the necessary rigidity. This is usually about 1–6 mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like.Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer .

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 can include polymers such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-aminobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110.

The blocking layer 4 should be continuous and can have a thickness ranging for example from about 0.01 to about 20 micrometers, preferably from about 0.05 to about 5 micrometers.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 30:100 is satisfactory for spray and dip coating.

The Adhesive Layer

An intermediate layer 5 between the blocking layer and the charge generating layer may, if desired, be provided to promote adhesion. However, in the present invention, a dip coated aluminum drum may be utilized without an adhesive layer. Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-forming polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, 8 polyurethane, polymethyl methacrylate, and the like. The adhesive layer may be composed of a polyester with a $M_w$ of from about 50,000 to about 100,000, and preferably about 70,000, and a $M_n$ of preferably about 35,000.

The Imaging Layer(s)

The imaging layer refers to a layer or layers containing charge generating material, charge transport material, or both the charge generating material and the charge transport material.

The phrase "n-type" refers to photoactive materials which predominately transport electrons when illuminated with light. Typical n-type materials include dibromoanthanthrone, benzimidazole perylene, zinc oxide, titanium oxide, azo compounds such as chlorodiane Blue and bisazo pigments, substituted 2,4-dibromotriazines, polynuclear aromatic quinones, zinc sulfide, and the like.

The phrase "p-type" refers to photoactive materials which transport holes when illuminated with light. Typical p-type organic pigments include, for example, metal-free phthalocyanine, titanyl phthlialocyanine, gallium phthalocyanine, hydroxy gallium phthalocyanine, chlorogallium phthalocyanine, copper phthalocyanine, and the like. P-type charge generating materials may be an intrinsic pigment.

The n-type charge generating material may be an extrinsic pigment. Particles of the n-type charge generating material may be entirely a grain shape, entirely a needle shape, or a mixture of particles having a grain shape and particles having a needle shape.

Preferably, the charge generating material exhibits insignificant particle aggregation and/or the needle shaped particles exhibit insignificant particle aggregation. The charge generating material and the needle shaped particles may be dispersed, randomly or substantially uniformly, throughout the imaging layer. In some embodiments, the charge generating material exhibits particle aggregation and/or the needle shaped particles exhibit particle aggregation.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments such as benzimidazole perylene; indigo pigments such as indigo, thioindigo, and the like; bisbenzoimidazole pigments such as Indofast Orange, and the like; phthalocyanine pigments such as copper phthalocyanine, alurninochloro-phthalocyanine, hydroxygallium phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

To create a dispersion useful as a coating composition, a solvent is used with the charge generating material. The solvent can be for example cyclohexanone, methyl ethyl ketone, methylene chloride, tetrahydrofuran, alkyl acetate, and mixtures thereof. The alkyl acetate (such as butyl acetate and amyl acetate) can have from 3 to 5 carbon atoms in the alkyl group. The amount of solvent in the composition ranges for example from about 70% to about 98% by weight, based on the weight of the composition.

The amount of the charge generating material in the composition ranges for example from about 0.5% to about 30% by weight, based on the weight of the composition including a solvent. The amount of photoconductive particles (i.e, the charge generating material) dispersed in a dried photoconductive coating varies to some extent with the specific photoconductive pigment particles selected. For example, when phthalocyanine organic pigments such as titanyl phthalocyanine and metal-free phthalocyanine are utilized, satisfactory results are achieved when the dried photoconductive coating comprises between about 30 percent by weight and about 90 percent by weight of all phthalocyanine pigments based on the total weight of the dried photoconductive coating. Since the photoconductive characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

The weight ratio of the charge generating material ("CGM") to the binder ranges from 30 (CGM):70 (binder) to 70 (CGM):30 (binder).

For multilayered photoreceptors comprising a charge generating layer (also referred herein as a photoconductive layer) and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Any suitable technique may be utilized to disperse the photoconductive particles in the binder and solvent of the coating composition. Typical dispersion techniques include, for example, ball milling, roll milling, milling in vertical attritors, sand milling, and the like. Typical milling times using a ball roll mill is between about 4 and about 6 days.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetrapbenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene; dinitroanthraquinone; and butylcarbonylfluorenemalononitrile, reference U.S. Pat. No. 4,921,769. Other hole transporting materials include arylamines described in U.S. Pat. No. 4,265,990, such as N,N'-diphenyl-N,N'-bis(alkylphenyl)-(1,1'-biphenyl)-4,4'-diamine wherein alkyl is selected from the group consisting of methyl, ethyl, propyl, butyl, hexyl, and the like. Other known charge transport layer molecules can be selected, reference for example U.S. Pat. No. 4,921,773 and 4,464,450.

Any suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer to the substrate. Typical coating techniques include dip coating, roll coating, spray coating, rotary atomizers, and the like. The coating techniques may use a wide concentration of solids. Preferably, the solids content is between about 2 percent by weight and 30 percent by weight based on the total weight of the dispersion. The expression "solids" refers to the photoconductive pigment particles and binder components of the charge generating coating dispersion and to the charge transport particles and binder components of the charge transport coating dispersion. These solids concentrations are useful in dip coating, roll, spray coating, and the like. Generally, a more concentrated coating dispersion is preferred for roll coating. Drying of the deposited coating may be effected by any suitable conventional technique such as oven drying, infra-red radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The materials and procedures described herein can be used to fabricate a single imaging layer type photoreceptor containing a binder, the needle shaped particles, a charge generating material, and a charge transport material.

In preferred embodiments, the amount of the needle shaped particles by weight is less than the amount of the charge generating material by weight in the imaging layer.

Where the imaging layer is a charge generating layer, illustrative amounts of the components contained therein are as follows: needle-like particles are present in an amount ranging for example from about 0.3% to about 30% by weight based on the imaging layer, preferably from about 0.5% to about 25% by weight based on the imaging layer; a binder is present in an amount ranging for example from about 20% to about 80% by weight, preferably from about 25% to about 70% by weight based on the imaging layer; and a charge generating material is present in an amount ranging for example from about 20% to about 80% by weight, preferably from about 30% to about 50% by weight based on the imaging layer.

Where the imaging layer is a single layer combining the functions of the charge generating layer and the charge transport layer, the components contained therein may include: the needle-like particles, a binder, a charge generating material, and a charge transport material.

The term "needle-like" or "needle shaped" means a long and narrow shape including a stick and pole and it is a shape having an aspect ratio L/S of a length L of the long axis to a length S of the short axis of about 1.5 or more. It is not necessary to be extremely long and narrow or have a sharp pointed end. The mean of the aspect ratio is preferably in the range from about 1.5 to about 300, more preferably from about 2 to about 10. The short axis and long axis of the particle diameter of the needle-like particles are about 0.01 micrometer or less and about 100 micrometer or less, respectively, more preferably, about 0.05 micrometer or less and about 10 micrometer or less, respectively.

Particles referred to as being grain shaped have a mean of the aspect ratio ranging from about 1 to about 1.3. The grain shaped particles have an approximately spherical shape despite some degree of unevenness.

Such methods as natural sedimentation method and photo-extinction method and the like may be used for measuring the particle diameter and aspect ratio. Microscopic observation may be preferably used for measuring the particle diameter and aspect ratio.

In the present invention, the needle-like particles may be composed of the same n-type material or a mixture of two or more n-type materials.

The needle shaped n-type particles may be inorganic, preferably a metal oxide such as titanium oxide ($TiO_2$), tin oxide, indium-doped tin oxide, antimony-doped tin oxide, and zinc oxide. "Doped" means that the doped material is incorporated in the metal oxide crystals. The needle shaped n-type particles may be an organic material such as dibromoanthanthrone and azo pigments.

Preferred needle-like particles are titanium oxide. Titanium oxide has two crystal forms including anatase and rutile, both of which can be used for the present invention singly or in combination.

In embodiments, the needle-like particles have a volume resistance ranging from $10^5$ ohm-cm to $10^{10}$ ohm-cm under a loading pressure of 100 $Kg/cm^2$. Hereinafter, the volume resistance provided when the loading pressure of 100 $Kg/cm^2$ is applied is referred to simply as a powder resistance.

Besides, as long as the powder resistance of the needle-like particles preferably remain within the above scope, the surface of the needle-like particles may remain untreated or may be coated with $Al_2O_3$, $SiO_2$, ZnO and the like or the mixture thereof for improvement in dispersion properties and surface smoothness.

Since the needle-like particles have a long and narrow shape, the particles are easily in contact with each other and the contact area between the particles is greater than that of grain-like particles (i.e., more spherical particles). Therefore, even if the content of the needle-like particles in the imaging layer is smaller than grain-like particles, the imaging layer having an equivalent properties can be easily produced. Employing a reduced amount of needle-like particles is advantageous for improving the film strength and adhesive properties with the conductive support. The properties of the photoreceptor containing the needle-like particles are not degraded after repeated use because the contact between the needle-like particles thereof are strong, whereby excellent stability is obtained. The needle shaped n-type particles can function as bridges between the imaging pigments to transport photogenerated electrons. By doping so, they assist in bringing out the electrons from the pigment surfaces and prevent the recombination of the photogenerated holes and electrons. Therefore, more photogenerated holes can be brought out of the imaging pigments and transport through the transport layer. The present invention hence improves the photoreceptor sensitivity.

The Overcoating Layer

Embodiments in accordance with the present invention can, optionally, further include an overcoating layer or layers 8, which, if employed, are positioned over the charge generation layer or over the charge transport layer. This layer comprises organic polymers or inorganic polymers that are electrically insulating or slightly semi-conductive.

Such a protective overcoating layer includes a film forming resin binder optionally doped with a charge transport material.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include MAKROLON™, a polycarbonate resin having a weight average molecular weight of about 50,000 to about 100,000 available from Farbenfabriken Bayer A. G., 4,4'-cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of about 1% by weight to about 10% by weight of the overcoating layer of VITEL™ copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N,N,N',N'-tetra-p-tolyl-4,4'-biphenyldiamine salt.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

The electrical properties of the photoconductive imaging samples prepared according to Comparative Example I and Examples I and II, were evaluated with a xerographic testing scanner comprising a cylindrical photoreceptor drum having a diameter of 8.4 cm. When rotated, the drum produced a constant surface speed of 7.4 cm per second. A direct current pin corotron, exposure light, erase light, and three electrometer probes were mounted around the periphery of the photoreceptor samples. The sample charging time was 33 milliseconds. Both expose and erase lights were Red LED bars with output wavelength at 660 mn. The output energy of the LED bar was controlled by varying the applied voltage to the LED bar. The relative locations of the probes and lights are indicated in the Table below:

TABLE

| Element | Angle (Degrees) |
|---|---|
| Charge | 0 |
| Probe 1 | 14 |
| Expose | 30 |
| Probe 2 | 90 |
| Erase | 225 |
| Probe 3 | 345 |

The test samples were first rested in the dark for at least 60 minutes to ensure achievement of equilibrium with the testing conditions at 35 percent relative humidity and 20° C. Each sample was then negatively charged in the dark to a development potential of about 700 volts. The charge acceptance of each sample and its residual potential after discharge by front erase exposure to 400 ergs/cm$^2$ were recorded. The test procedure was repeated to determine the photoinduced discharge characteristic (PIDC) of each sample by different light energies of up to 20 ergs/cm$^2$.

COMPARATIVE EXAMPLE I

A charge blocking layer is fabricated from a 14.4 percent by weight solution of Zirconium butoxide and gamma-aminopropyltri-methoxy silane in an isopropyl alcohol, butyl alcohol and water mixture. The isopropyl alcohol, butyl alcohol and water mixture percentages were 66, 33 and 1 percent. The zirconium butoxide and gamma-aminopropyltri-methoxy silane mixture percentages were 90 and 10 percent. The charge blocking layer is dip coated onto the aluminum drum substrate and dried at a temperature of 130° C. for 20 minutes. The dried zirconium silane film has a thickness of about 0.1 micrometer. A charge generation coating dispersion was prepared by dispersing 22 grams of benzirnidazole perylene particles having an average particle size of about 0.4 micrometer into a solution of 10 grams polyvinyl butyral (B-79, available from Monsanto Chemical Co.) dissolved in 368 grams of n-butyl acetate solvent. This dispersion was milled in a Dynomill mill (KDL, available from GlenMill) with zirconium balls having a diameter of 0.4 millimeter for 4 hours. The average particle size of the benzimidazole perylene pigments in the dispersion after the milling is about 0.1 micrometer. The drum with the charge blocking layer coating was dipped in the charge generation coating dispersion and withdrawn at a rate of 20 centimeters per minute. The resulting coated drum was air dried to form a 0.5 micrometer thick charge generating layer. A charge transport layer coating solution was prepared containing 40 grams of N,N'-diphenyl-N,N'-bis(3-methylphenyl)-(1,1'-biphenyl)-4,4'-diamine and 60 grams of poly(4,4'-diphenyl-1,1'-cyclohexane carbonate) (PCZ 400 available from Mitsubishi Chemical Co. ) dissolved in a solvent mixture containing 80 grams of monochlorobenzene and 320 grams of tetrahydrofuran. The charge transport coating solution was applied onto the coated drum by dipping the drum into the charge transport coating solution and withdrawn at a rate of 150 centimeters per second. The coated drum was dried at 110° C. for 20 minutes to form a 20 micrometer thick charge transport layer. The resulting photoreceptor drum was electrically cycled in a scanner in a controlled atmosphere of 35 percent relative humidity and 20° C. The scanner is described above.

EXAMPLE I

The process described in Comparative Example I was repeated except that the charge generation layer dispersion used for coating was different. The charge generation layer dispersion was prepared as described in the Comparative Example I, but was modified by the addition of 2.2 gram needle shaped $TiO_2$ (STR-60N, 10 nm×50 nm size, from Sakai Chem. Co., Japan. ) after the milling. When the resulting photoreceptor drum was electrically cycled in a scanner under the same conditions as described in Comparative Example I, there was an improvement on sensitivity with this charge generation layer dispersion.

EXAMPLE II

The process described in Comparative Example I is repeated except that the charge generation layer dispersion used for coating is different. The charge generation layer dispersion is prepared as described in the Comparative Example I, but was modified by the addition of 2.2 gram of needle shaped $TiO_2$ (STR-60A, $TiO_2$ surface treated with $Al_2O_3$, 10 nm×50 nm size, from Sakai Chem. Co., Japan. ) The resulting photoreceptor drum is electrically cycled in a scanner under the same conditions as described in Comparative Example I. The sensitivity is improved by lowering the surface voltage at the PIDC tail, evident as the lower voltage reading at 9 ergs/cm$^2$ exposure energy as compared to the readings for Comparative Example I and Example I.

The results of the scanner test are shown in the following table:

| | Comparative Example I | Example I |
|---|---|---|
| $V_H$ | 687 | 677 |
| Dark decay (Volts) | 24 | 34 |
| dV/dX (V.cm$^2$/erg) | 100 | 110 |
| V (9 ergs/cm$^2$) | 76 | 40 |
| $V_r$ (Volts) | 9 | 9 |

The symbols employed in the above table are defined as follows:

Dark Decay is the voltage difference between the first and second probes.

$V_H$ is the voltage measured at the first probe.

dV/dX is is the initial slope of the PIDC curve.

V (9 ergs/cm$^2$) is the voltage measured at the first probe after the photoreceptor is exposed to light of intensity 9 ergs/cm$^2$.

$V_r$ is the voltage measured at the third probe.

Other modifications of the present invention may occur to those skilled in the art based upon a reading of the present disclosure and these modifications are intended to be included within the scope of the present invention.

We claim:

1. A photoreceptor comprising:

(a) a substrate;

(b) a charge generating layer including a binder, a n-type charge generating material, and a plurality of needle shaped n-type particles wherein the charge generating material and the needle shaped n-type particles are different compounds; and (c) a charge transport layer, wherein the charge generating layer and the charge transport layer are in any sequence over the substrate.

2. The photoreceptor of claim 1, wherein the charge generating layer is positioned between the substrate and the charge transport layer.

3. The photoreceptor of claim 1, wherein the charge generating material is benzimidazole perylene.

4. The photoreceptor of claim 1, wherein the needle shaped n-type particles are present in an amount ranging from about 0.3% to about 30% by weight based on the charge generating layer.

5. The photoreceptor of claim 1, wherein the needle shaped n-type particles are present in an amount ranging from about 0.5% to about 25% by weight based on the charge generating layer.

6. The photoreceptor of claim 1, wherein the needle shaped n-type particles have a short axis S having a length of about 1 micrometer or less and a long axis L having a length of about 100 micrometers or less, and the aspect ratio of L/S ranging from about 1.5 to about 300.

7. The photoreceptor of claim 1, wherein the needle shaped n-type particles have a short axis S having a length of about 0.5 micrometer or less and a long axis L having a length of about 10 micrometers or less, and the aspect ratio of L/S ranging from about 2 to about 10.

8. The photoreceptor of claim 1, wherein the needle shaped n-type particles are inorganic.

9.The photoreceptor of claim 1, wherein the needle shaped n-type particles are a metal oxide.

10. The photoreceptor of claim 1, wherein the needle shaped n-type particles are selected from the group consisting of: titanium oxide, tin oxide, indium-doped tin oxide, antimony-doped tin oxide, and zinc oxide.

11. The photoreceptor of claim 1, wherein the charge generating material exhibits insignificant particle aggregation and the needle shaped particles exhibit insignificant particle aggregation.

* * * * *